US006230648B1

(12) United States Patent
Davidson et al.

(10) Patent No.: US 6,230,648 B1
(45) Date of Patent: May 15, 2001

(54) VERSATILE MOTOR BOAT

(75) Inventors: Andrew M. Davidson; Samuel L. Davidson, both of Monroe, LA (US)

(73) Assignee: Duracraft Marine Corporation, Delhi, LA (US)

( * ) Notice: Subject to any disclaimer, the term of this patent is extended or adjusted under 35 U.S.C. 154(b) by 0 days.

(21) Appl. No.: 09/525,522

(22) Filed: Mar. 15, 2000

(51) Int. Cl.[7] ..... B63B 17/00
(52) U.S. Cl. ..... 114/363
(58) Field of Search ..... 114/363, 343; D12/300, 317

(56) References Cited

U.S. PATENT DOCUMENTS

| | | | |
|---|---|---|---|
| 2,472,185 | | 6/1949 | Apel . |
| 3,065,020 | | 11/1962 | Cox . |
| 3,376,589 | | 4/1968 | Staron . |
| 3,473,176 | | 10/1969 | Taylor . |
| 3,475,773 | | 11/1969 | Codman, Jr. . |
| 4,234,989 | * | 11/1980 | Pearcy . |
| 4,567,845 | | 2/1986 | Smith . |
| 4,738,217 | | 4/1988 | Smith . |
| 4,821,445 | * | 4/1989 | Bass . |
| 4,841,203 | * | 6/1989 | Gilbert . |
| 4,919,068 | | 4/1990 | Lathers . |
| 4,926,783 | | 5/1990 | Lathers . |
| 4,945,853 | | 8/1990 | Lathers . |
| 5,197,406 | * | 3/1993 | Rabal et al. . |
| 5,799,605 | | 9/1998 | Huse . |
| 5,956,810 | * | 9/1999 | Spaeth . |

OTHER PUBLICATIONS

Chatlee Boat & Marine—Evinrude, "The World's Most Refined Engines". (Sell Sheet).
Fisher Boats, "Fish Forever". (Sell Sheet).
Grubbs Marine—Crestliner. (Sell Sheet).
Skeeter Performance Fishing Boats. (Sell Sheet).
Champion—"The Best by Any Measure", R & K Marine (Sell Sheet).
Wellcraft 180 Fisherman, Grubbs Marine (Sell Sheet).
Skeeter Performance Fishing Boats (Sell Sheet).
Princecraft (Sell Sheet).
Hurricane Deck Boats (Sell Sheet).
Formula Mercury—MerCruiser (Sell Sheet).
Stingray Powerboats—Mercury (Sell Sheet).
Fisher Pontoon Boats—Luxury For Life (Sell Sheet).
Original Stylish—Suncruiser by Lowe (Sell Sheet).

* cited by examiner

*Primary Examiner*—Sherman Basinger
(74) *Attorney, Agent, or Firm*—Jacobson, Price, Holman & Stern, PLLC

(57) ABSTRACT

A versatile motor boat having front and rear casting platforms and side platforms, a center console and oppositely facing, front and rear seat assemblies. Both seat assemblies can be opened to provide maximum seating when the boat is to be used for cruising. The front seat assembly may be collapsed to provide an extended front casting platform when it is desired to use the boat as a bay or striper boat. Both seat assemblies can be folded down to extend the front and rear casting platforms for use of the boat as a bass boat. When the seat assemblies are collapsed, supports are provided for a rigid back member forming part of each seat back and latches secure the seat backs in their collapsed position so that the rear surfaces of the rigid members provide stable extended casting platforms.

6 Claims, 5 Drawing Sheets

VERSATILE MOTOR BOAT

FIELD OF THE INVENTION

This invention relates to boats, and relates more particularly to a highly versatile motor boat which can be readily converted to different configurations for use as a bass boat, a striper, catfish or bay boat, and a "runabout", deck or pontoon boat.

BACKGROUND OF THE INVENTION

Heretofore, small motor boats have been configured for different functional application with little versatility. For example, one form of fishing boat is commonly referred to as a "bass" boat. Bass boats normally have raised front and rear fishing platforms with pedestal-type fishing seats removably mounted on the platforms for bass fishing from the bow as well as the stern of the boats. Boats of this nature commonly include under-platform storage boxes, gas tank and live wells, as well as a side console with a steering system. Emphasis in a bass boat is on maximizing platform space, with little concern for cockpit space or seating capacity.

Another form of common fishing boat is a "bay" or so-called "striper" boat, which is usually provided with increased cockpit space and a center console, allowing the users to walk around the cockpit. Certain versions of the bay boats, often called "flats" boats, have large front and rear decks or platforms, as well as side decks along the sides of the cockpit to allow a fisherman to walk from front to back without having to step down on the cockpit floor.

Contrary to the bass and bay configurations, primarily designed for particular types of fishing, "play" boats take various forms. "Deck" boats and "pontoons" are known for their large seating capacity. So-called "fish and ski" units and "runabouts" have a cockpit with multiple seats to accommodate passengers and with so-called "wraparound windshields" that protect the cockpit area. Regardless of the specific configuration of the "play" boats, the common theme is to maximize passenger seating. While fishing from the conventional "play" boats is possible, it is not particularly convenient.

With these somewhat inconsistent requirements of the various types of small motor boats, it has been necessary to either have a multiplicity of boats for different functional applications, an expensive proposition not economically feasible for much of the boating public, or to settle for a compromise if a specific configuration is used for an alternate purpose.

SUMMARY OF THE INVENTION

The primary object of the instant invention is to provide a highly versatile motor boat construction readily modified for use as either a bass boat, a bay boat or a play boat in a simple and expeditious manner, without having to compromise functional capability. To this end, the boat is provided with forwardly-facing "group" or bench seating at the rear of a center cockpit with a steering console operable from such seating, and rearwardly-facing group seating at the forward end of the center cockpit. Such a configuration maximizes the seating capacity when the boat is to be used for family entertainment. If desired, the front seat can be folded on itself in a unique manner to provide an expanded front casting platform which can receive a removable pedestal seat when the boat is to be used for bass fishing. As another alternative, for use as a bay boat both seats can be folded down in a unique manner to provide spacious front and rear casting platforms with walk-around side decks surrounding the center cockpit and console.

To complete the functional versatility of the boat of the instant invention, it can provided with a bimini top, a ski tow bar and a ladder when used in its play or cruising version, and live wells as needed, a removable trolling motor mount, rod storage and removable pedestal seats when used either in its bass or bay versions.

A further object is the provision of a boat which can have permanent front and rear decks selectively enlarged by the unique construction of the boat of this invention with storage and live wells as needed for fishing, while portions of the decks may be easily transformed into group seating fore and aft, with an openable bimini top for shade if it is desired to use the boat for cruising with a large number of passengers.

Yet another object of this invention is the provision of a unique mechanism for enabling cushioned seat bottom and seat back elements of collapsible seat assemblies in a convertible motor boat of the type described to be moved from a first operative position in which the seat back is disposed at an angle with relation to its respective seat bottom to form a bench seat, to a second operative position in which the seat back overlies its respective seat bottom with the rear surface of the seat back level with, and forming an extension of; its respective casting platform.

A still further object of this invention is the provision of a rigid member carrying the cushion on each seat back, with side portions of the rigid member extending beyond the cushion, fixed elements underlying the side portions of the rigid member of the seat back when it is pivoted downwardly in overlying relationship to the seat bottom, and latching means to secure the seat back in its collapsed position to thereby support the rigid member with its rear surface stable, immovable and level with its respective casting platform.

Another object of this invention is the provision of unique hinge assemblies each comprising a first fixed member, a second member secured to one side of the rigid seat back element, and a third member pivotally secured at one end to the first member and pivotally secured at an opposite end to the second member, with the spacing between the pivotal connections of the third member to the first and second members, respectively, accommodating the thickness of the cushions on the seat bottom and the seat back when the seat back is folded into overlying relationship with the seat bottom to form an extended part of its respective casting platform.

Other and further objects of this invention will be set forth hereinafter or obvious from the following detailed description.

BRIEF DESCRIPTION OF THE DRAWINGS

Like reference characters refer to like parts throughout the several views of the drawings.

DETAILED DESCRIPTION OF THE PREFERRED EMBODIMENTS

Figure 1:
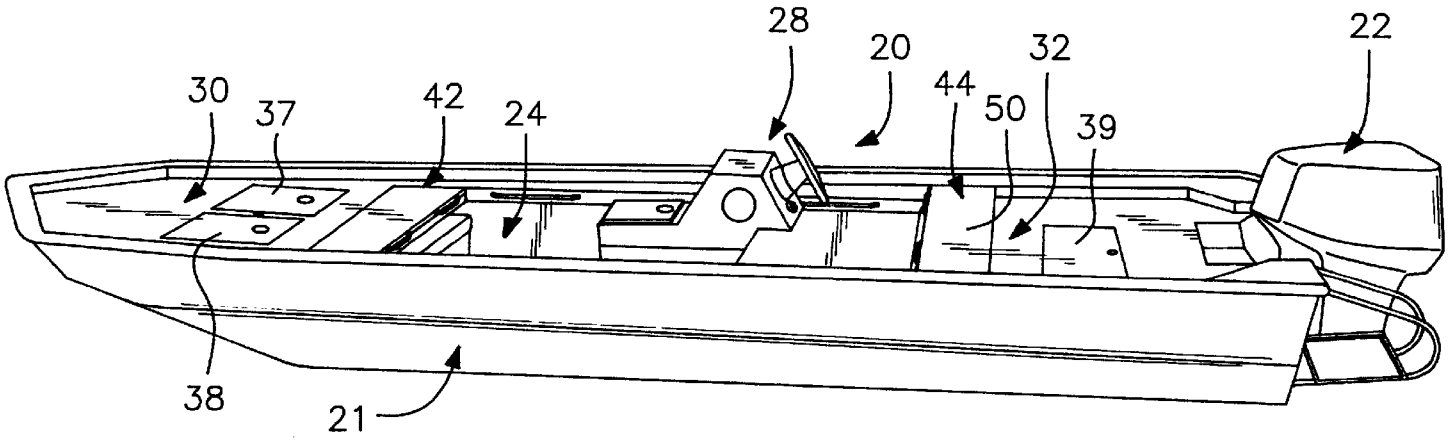
FIG. 1 is a side perspective view of one embodiment of a motor boat according to the instant inventive concepts adapted for use as a bay boat.

Referring now to the drawings in general, a motor boat according to preferred embodiments of the instant inventive concepts is illustrated generally at 20. The boat 20 is shown reconfigured according to this invention to its "bass" version in FIG. 1, its "play" version in FIG. 2 and its "bay" version in FIG. 3.

The boat 20 comprises a hull 21 which can be formed of aluminum, although fiberglass or other materials can be substituted therefor. Preferably, the hull 21 has a wide beam, on the order, perhaps, of 90–96 inches. The bottom configuration of the hull is preferably a 12° sport vee, namely a hull with a bottom that has a 6° slope from the horizontal on either side of the keel. In a 94 inch beam unit, the bottom is preferably 74 inches and slopes outwardly to the gunwale to a maximum of 10 inches on either side.

Although the foregoing dimensions are preferred, the versatility of the motor boat of the instant invention can apply to narrower and/or wider boats. However, a boat with less than about a 60 inch bottom, or less than about a 17.5 foot length, would minimize the cockpit and seating advantages afforded by the unique construction discussed in more detail below. The bottom contour, however, would not make a significant difference so long as the stability is not sacrificed.

The foregoing materials and dimensions are provided to illustrate the preferred construction of a versatile motor boat according to the instant inventive concepts, but are not to be taken as limiting thereon.

Figure 2:
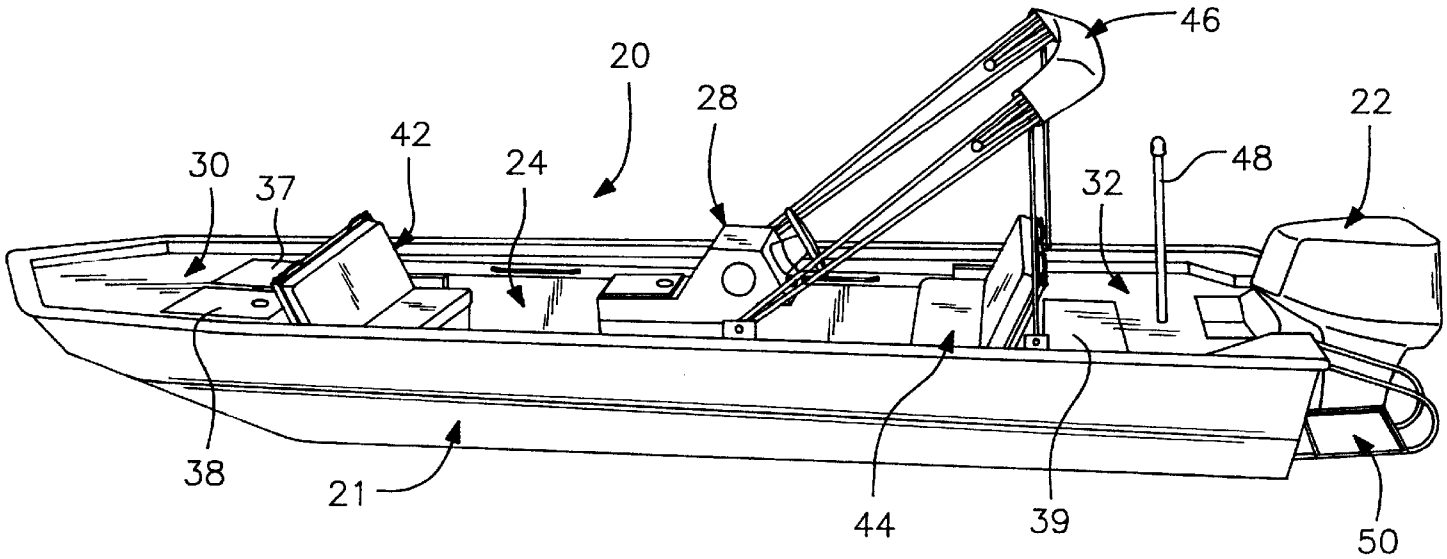
FIG. 2 is a side perspective view of the play version of the boat of FIG. 1.

Of course, the boat 20 can be provided with a source of power, an outboard motor being illustrated at 22 in place in FIGS. 1 and 2. A trolling motor bracket, illustrated in dotted lines in FIG. 3 at 23, is removably attached to the boat 20 in a conventional manner for reception of a trolling motor (not shown) principally used in the bass boat configuration. When not in use the trolling motor and bracket may be stored in any of the storage compartments or under the seat assemblies to be discussed in more detail hereinafter.

The boat 20 has a center cockpit area 24 with a floor 26 onto which is mounted a steering console 28. At the front end of the cockpit 26 is a raised front casting platform or deck 30 and at the rear end of the cockpit 26 is a raised rear casting platform or deck 32. According to a preferred construction of the boat of the instant inventive concepts, the front and rear casting platforms 30, 32 are interconnected by side platforms 34, 36 to enable a fisherman to walk between the front and rear casting platforms 30, 32 without having to step down onto the cockpit floor 26.

The front casting platform 30 can be provided with underdeck storage compartments, access for two such compartments being illustrated at 37, 38. One or both of the compartments 37, 38 may be outfitted with a water circulating system (not shown) to make the same a live well in a manner well known in the bass boat art. Other underdeck storage compartments can also be made as live wells, if desired.

The rear casting platform 32 can be provided with one or more further storage compartments access to one such compartment be illustrated at 39, as well as an underdeck area for a battery.

Immediately behind the front casting deck 30 and above the cockpit floor 26 is a compartment which may house a gas tank that can be filled through an opening 41 with a standard gas fill hooked to the gas input by a hose, with lines leading from the tank for venting and fuel feed purposes. Alternately, the gas tank and accompanying elements may be located in front of the rear casting platform 32. Details of these elements are shown in the drawings since their construction and placement are not important to the instant inventive concepts.

In the "play" configuration of the boat 20 of the instant invention, seen particularly in FIG. 2, front and rear facing "group" or bench seats 42, 44 are provided on opposite sides of the center console 28. These seats provide for multiple passengers arranged in a conversation grouping. The forwardly facing rear bench seat 44 is positioned so as to allow a person sitting thereon to operate the controls on the steering console 28.

When the boat is used for cruising, it is common to provide a removable bimini top 46 seen in its "radar arch" configuration in FIG. 2. When opened (not shown), the top 46 will provide cover to the cockpit 24 to protect the passengers from the sun. Bimini tops are well known in the deck boat and pontoon boat art.

The configuration shown in FIG. 2 is referred to as the "play" version since it is configured for cruising, or skiing, especially when equipped with a ski bar 48, and a boarding ladder and swim platform 50.

The front and rear seat assemblies 42, 44 are identical for all practical purposes, except for their orientation when opened to form bench seats. The front bench seat 42 faces rearwardly and the rear bench seat 44 faces forwardly. For ease of illustration only the front seat assembly is described in detail and illustrated, particularly in FIGS. 4–9.

Figure 5:
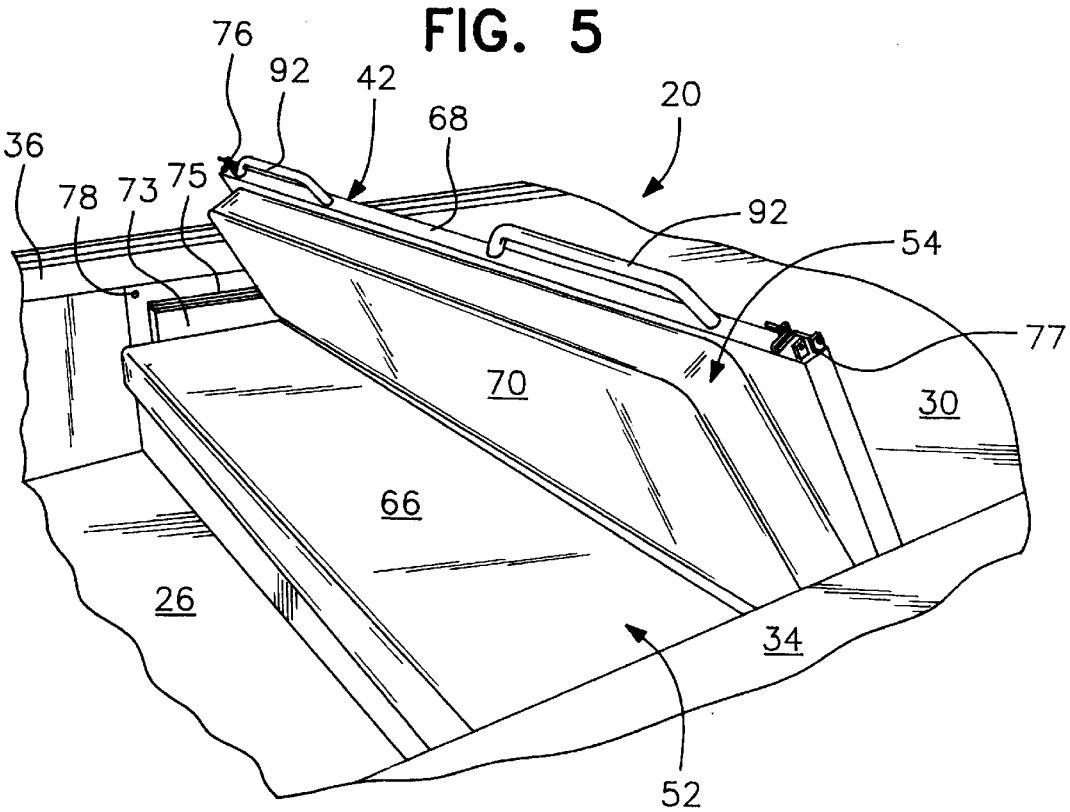
FIG. 5 is a fragmentary perspective view of the seat assembly showing the seat back being moved to a posit overlying the seat bottom.
Figure 6:
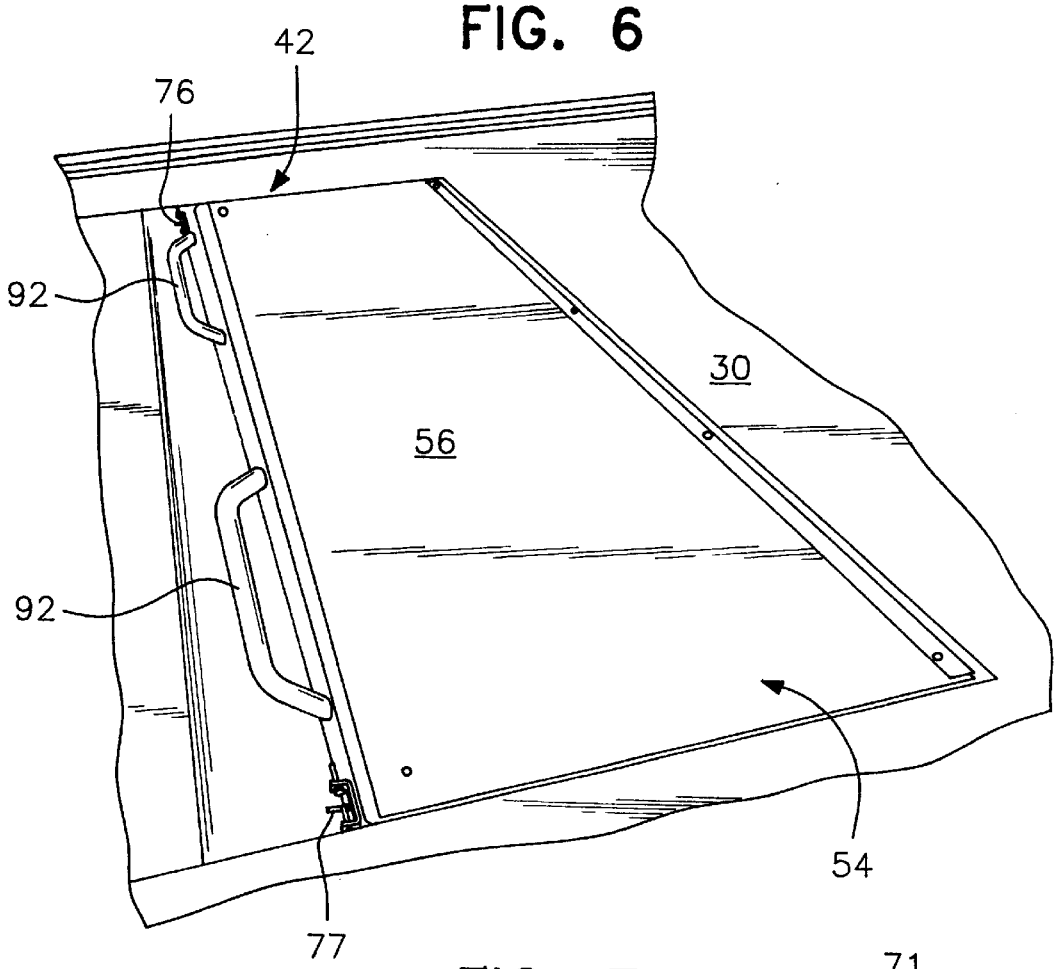
FIG. 6 is a further view of the seat assembly with the seat back fully collapsed to form an extension of the front and side casting platforms.
Figure 7:
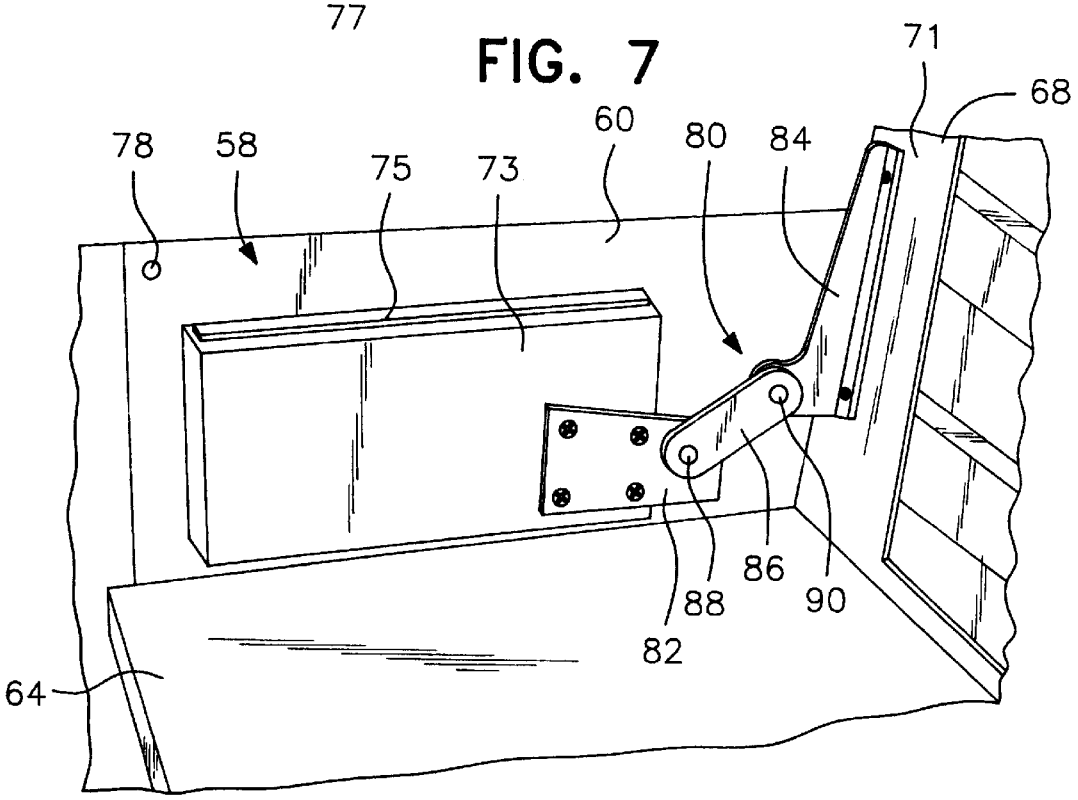
FIG. 7 is an enlarged fragmentary view showing a side support for the rigid element of the seat backs and the unique hinge assembly, with the seat bottom and seat back cushions removed for illustrative clarity.
Figure 8:
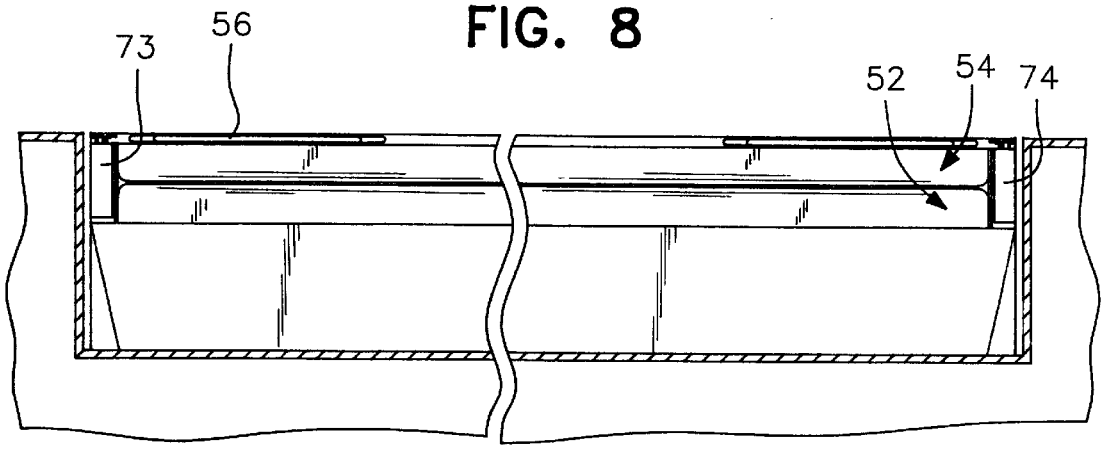
FIG. 8 is a fragmentary transverse cross-sectional view showing the seat back fully collapsed and supported to form a stable extension of the front and side casting platforms.
Figure 9:
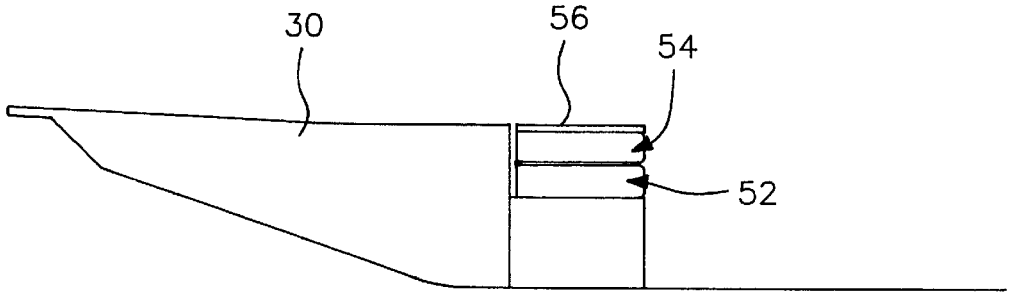
FIG. 9 is a partial schematic side elevational view showing a seat assembly fully collapsed.

The seat assembly comprises a seat bottom 52 and a seat back 54 which, in the fully opened position form a bench seat, with the seat back preferably disposed at an angle from approximately 100–130° with respect to the seat bottom 52. When it is desired to extend the front casting platform 30 for conversion of the "play" boat of FIG. 2 to the "bass" version seen in FIG. 3, the seat back 54 can be moved to a second operative position in which it overlies its respective seat bottom 52, with the rear surface 56 of the seat back 54 level with the front casting platform 30. FIG. 5 shows the seat assembly 42, partially collapsed, and FIGS. 6, 8 and 9 show the same in its fully collapsed, deck-extending, position.

For ease in manufacture, each of the seat assemblies preferably comprises a rigid frame designated generally by the reference numeral 58, including opposed sides 60, 62 and a bottom 64. The seat bottom 52 is hinged or fixed to the bottom 64 of the frame and includes a cushion 66 secured to its upper surface in any conventional manner. If hinged, storage may be provided under the seat for a trolling bracket and motor as suggested above, or for storage of other items.

The seat back 54 comprises a rigid member 68, with a cushion 70 secured to its front surface so that when the seat assembly is in its filly open operative position (FIG. 4), a comfortable, fully cushioned, group or bench seat is provided to accommodate several passengers. The rigid member 68 is wider than the cushion 70 to provide side portions 71, 72 of the rigid member extending beyond the sides of the cushion 70. Support elements 73, 74 are provided on the sides 60, 62 of the frame 58 to underlie the side portions 71, 72, respectively, of the rigid member 68 of the seat back 54 to support the seat back in its collapsed position and ensure that the rear surface 56 of the seat back 54 forms a stable continuation of its associated casting platform, as well as the related portions of the side platforms. In the absence of fixed supports such as 73, 74 the cushion-to-cushion contact between the cushion 68, 70 would make the extension of the casting and side platforms relatively unstable.

Plastic or rubber inserts such as illustrated at 75 may be carried by the supporting surface of the support elements 73, 74 to avoid marring the side portions 71, 72 of the rigid member 68 of the seat back 54 when the seat back overlies the seat bottom 52 and is stepped on as an extension to the casting platform 30.

Since the rigid member 68 of the seat back 54 is larger than the fixed supports 73, 74 there is a possibility that the extended casting platform provided by its rear surface 56 would pivot or tilt if a fisherman were to step on the very front or rear edges of the rear surface 56 of the rigid member 68 in the collapsed position of the seat back 54. To preclude any such instability it is important to securely latch the rigid member 68 in its deck-extending position as by the dead-bolt latches illustrated at 76, 77 slidably engageable in opening 78, 79, respectively in the sides 60, 62 of the seat frame 58. The dead bolts can even extend through the sides 60, 62 of the frame 58 into the vertical walls underlying the side platforms 34, 36.

While sidable dead bolt latches are illustrated, it will be recognized by those skilled in this art that other forms of latching means can be substituted therefor, so long as the extended casting platforms provided by the rear surfaces 56 of the rigid members 68 are immovably fixed in the collapsed position of the seat backs 54 to provide a stable support for a fisherman to walk on.

The rigid member 68 of the seat back 54 is pivoted in relation to the seat bottom 52 by a double-acting hinge assembly on each side, one of which is shown in detail at 80 in FIG. 8. The hinge assembly 80 includes a first member 82 fixed to the side support 73, a second member 84 fixed to one side portion 71 of the rigid seat back member 68, and a third member 86 pivotally secured at one end 88 to the first member 82 and pivotally secured at its opposite end 90 to the second member 84. The spacing between the pivotal connections 88, 90 accommodate the thickness of the cushions 66, 70, to allow the rear surface 56 of the rigid member 68 of the seat back 54 to extend in a continuous manner from the casting and side platform as seen schematically in FIG. 9.

Handles 92 are provided on the rigid member 68 of the seat back 54 to facilitate lifting the seat back from its bench seat upright position to its folded down extended casting platform position, and vice-versa.

Figure 3:
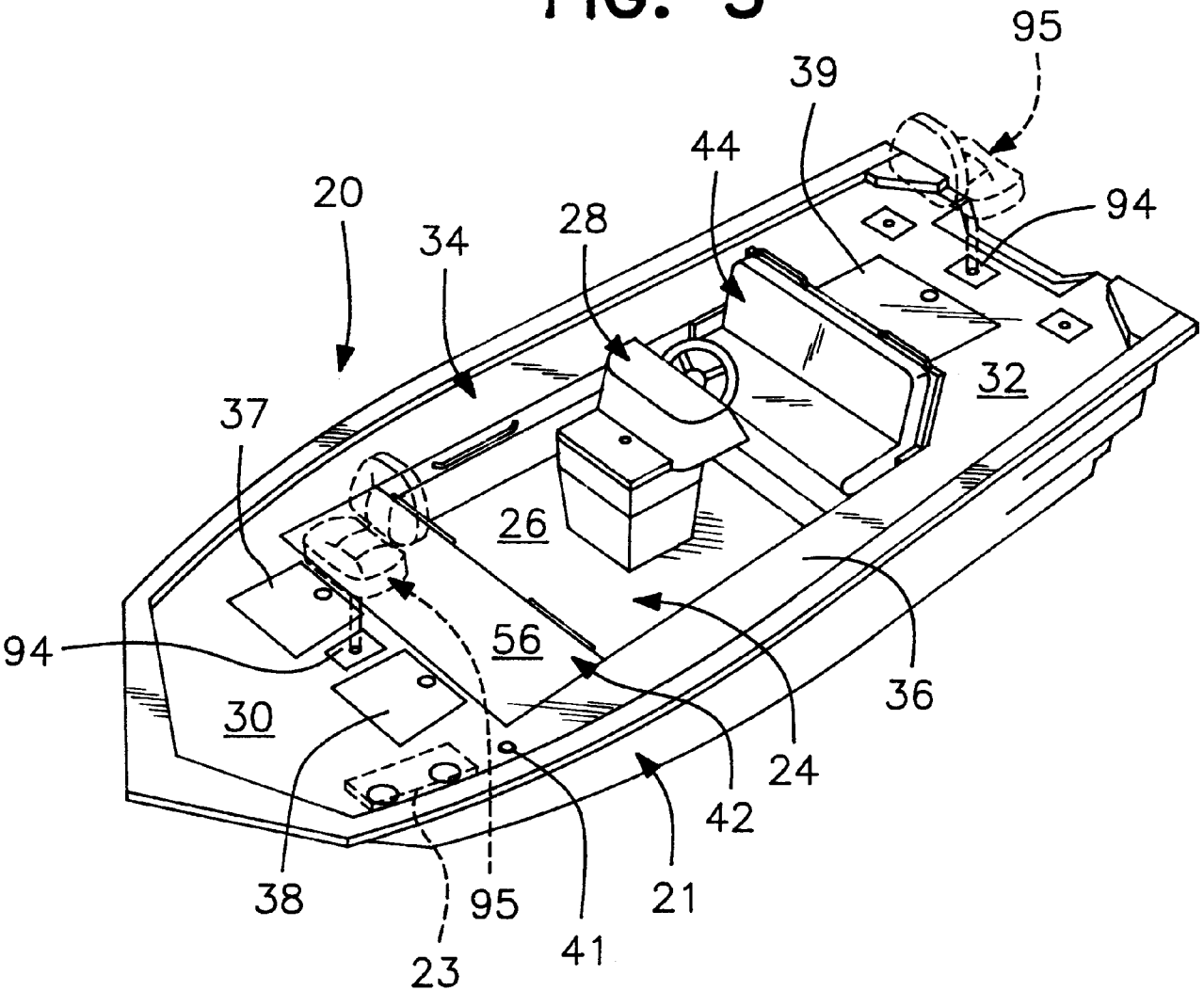
FIG. 3 is a front perspective view of the boat of FIG. 1 further reconfigured to use as a bass boat.
Figure 4:
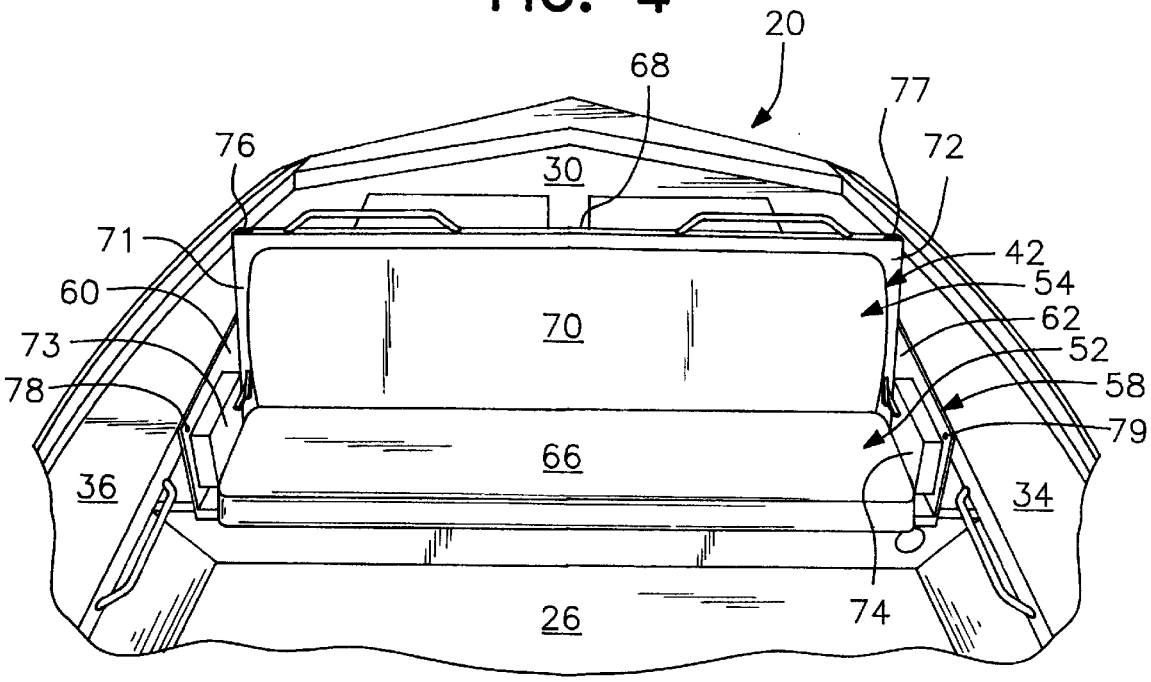
FIG. 4 is a fragmentary enlarged perspective view of the front seat assembly showing the seat bottom and seat back disposed at an angle with relation to each other to form a bench seat.

Returning now to FIGS. 1–3, with both seats raised as seen in FIG. 2, the boat provides maximum seating capacity for play, e.g, cruising or skiing. With the front seat collapsed as seen in FIG. 3, the front casting platform is extended and the boat is particularly well configured for use as a bay boat. Finally, with both seats collapsed as seen in FIG. 1, the boat provides maximum platform area as is desirable when the boat is to be used as a bass boat.

One or more pedestal seats can be provided on the front and/or rear casting platforms 30, 32 when the boat is to be used for fishing. While such seats can be permanently mounted, they are generally removably secured in pedestal mounts, such as shown at 94. Two such seats are illustrated in dotted lines at 95 in FIG. 3.

It is evident that the conversion of the boat between these various configurations is very simple, and the seats, as well as the casting platform extensions formed therefrom are stable and functional, enabling a single boat to be used for various purposes with little or no difficulty.

Having described the invention, many modifications thereto will become apparent to those skilled in the art to which it pertains without deviation from the spirit of the invention as defined by the scope of the appended claims.

What is claimed is:

1. A motor boat comprising a front casting platform a rear casting platform side platforms extending between said front and rear casting platforms, an open cockpit between said front and rear casting platforms and said side platforms, a floor in said cockpit below said casting platforms, a steering console located on said floor, two bench seat assemblies, each bench seat assembly comprising a seat bottom and a seat back, each seat bottom being supported between said side platforms above said floor and below said casting platforms, hinge assemblies operatively connected to opposite sides of each seat back to pivotally support said seat back for selective movement between a first operative position in which said seat back is disposed at an angle with relation to its respective seat bottom to form a bench seat, and a second operative position in which said seat back overlies its respective seat bottom with the rear surface of said seat back level with said casting platforms, one of said bench seat assemblies being disposed at the rear of said cockpit so that said bench seat which can be formed thereby in said first operative position of its seat back faces forwardly and said rear surface of said seat back in its second operative position forms an extension of said rear casting platform, the other of said seat assemblies being disposed at the front of said cockpit so that said bench seat which can be formed thereby in said first operative position of its seat back faces rearwardly and said rear surface of said seat back in its second operative position forms an extension of said front casting platform, and latching means for securely fixing said seat backs in said second operative positions to stabilize the extended casting platform provided by said rear surfaces of said seat backs in that position.

2. The boat of claim 1 wherein said console is positioned in said cockpit so as to allow a person sitting on the forwardly facing bench seat to operate controls thereon.

3. The boat of claim 1 wherein said seat base and said seat back of each seat assembly each comprises a cushion, said cushions of each seat assembly facing each other when said seat back is in said second operative position, each seat back including a rigid member carrying its respective cushion on one side, the opposite side of said rigid member defining said rear surface of said seat back, side portions of said rigid member extending beyond its respective cushion, and fixed elements underlying said side portions of said rigid member in said second operative positions of said seat back to support said rigid member with its rear surface level with its respective casting platform.

4. The boat of claim 3 wherein said latching means comprises a deadbolt lock slidably secured to each side of said rigid member, and a deadbolt-receiving aperture defined in fixed portions of said boat aligned with each deadbolt.

5. The boat of claim 3 wherein each hinge assembly comprises a first fixed member, a second member secured to said one side of said rigid seat back member, and a third member pivotally secured at one end to said first member and pivotally secured at an opposite end to said second member, the spacing between the pivotal connections of said third member to said first and second members, respectively, accommodating the thickness of said cushions on said seat bottom and said seat back when said seat back is in its second operative position.

6. The boat of claim 1 further including storage compartments under each of said front and rear casting platforms.

* * * * *